United States Patent [19]

Evans

[11] Patent Number: 4,632,264

[45] Date of Patent: Dec. 30, 1986

[54] PLASTIC CAP HAVING A SEAL AND BEING CHILD-PROOF

[75] Inventor: Santagiuliana Evans, Vicenza, Italy

[73] Assignee: Taplast S.n.c., Vicenza, Italy

[21] Appl. No.: 808,090

[22] Filed: Dec. 12, 1985

[30] Foreign Application Priority Data

Dec. 13, 1984 [IT] Italy ..... 85668 A/84

[51] Int. Cl.[4] ..... B65D 55/02

[52] U.S. Cl. ..... 215/220

[58] Field of Search ..... 215/220, 219

[56] References Cited

U.S. PATENT DOCUMENTS

| | | | |
|---|---|---|---|
| 3,968,894 | 7/1976 | Herrmann | 215/220 |
| 4,393,977 | 7/1983 | Willingham | 215/220 |
| 4,410,098 | 10/1983 | Dubs et al. | 215/220 |
| 4,555,036 | 11/1985 | Bekkers et al. | 215/220 |

*Primary Examiner*—George T. Hall

*Attorney, Agent, or Firm*—Birch, Stewart, Kolasch & Birch

[57] ABSTRACT

A cap with a safety opening system which includes an inside element (10) being screwed on the bottle neck, an outside cylindrical element (30) being coaxial to the inside element and a push-button (20) placed between the inside element and the outside one.

When the push-button (20) is pressed toward the bottle, it interacts with the cogged rim (16) being present on the upper part of the inside element and it works as a transmission means between the outside element (30) being made to rotate in the cap untightening direction, and the inside element (10) being screwed on the neck of the bottle. When the pressure exerted by the push-button (20) stops, it is only possible to tighten the cap by rotating the outside element (30), said element being provided with a cogged rim (14) on its internal lateral surface (31) which engages with a corresponding cogged rim (13) being present on the external cylindrical surface of the inside element (10). Said pair of cogged rims is ineffective in the untightening direction, since the cogs are arranged in such a direction that they slide on each other without engaging with each other.

6 Claims, 6 Drawing Figures

PLASTIC CAP HAVING A SEAL AND BEING CHILD-PROOFBACKGROUND AND SUMMARY OF THE INVENTION

The invention concerns the creation of a cap, preferably made of plastic, being provided with a seal and having a safety-opening system, particularly useful for bottles containing medicines or other potentially dangerous substances.

One of the expedients used by those who put on the market potentially dangerous substances is that of providing the containers of said substances with opening caps, which somehow guarantee the exit of said substances in a gradual way and in a certain quantity which would cause no damage.

Another element of primary importance is that the containers or the bottles containing for instance poisons, corrosive liquids or even medicines should not be likely to be easily opened by children. In some countries there are some laws regulating medicaments, which force the medicine manufacturers to put medicines into bottles provided with the so-called child-proof caps, that is with caps, which can only be opened with a certain co-ordination of movements of the fingers of the hand, even after the seal has been removed. In this respect some caps, mostly made of plastic are known, which consist of two parts, that is of an inside cap, which is tightened around the neck of the bottle, and of an outside cap, which is superimposed to the inside one and coaxial with it, being provided with a strip-like seal.

The inside cap and the outside cap present on their cylindrical surfaces two cog-rims facing each other and having cogs positioned in such a direction that they can only engage each other in the tightening direction of the cap, while they slide on each other in the untightening direction. In order to obtain the opening of the cap it is necessary to remove the tear-off strip, the bottom part of which is blocked in an indentation being present in the neck of the bottle, and then to press the outside cap axially downward against the bottle, while rotating it at the same time, so that the untightening occurs because of the action performed by yet another set of cogs being present both in the inside and in the outside cap, on the upper surfaces of said caps.

One of the inconveniences presented by this solution is that the bottles suited to receive said caps must be provided with an indented ring on their neck, so that they can receive the sealing strip, and this represents a complication in the manufacture of the bottles, because of the presence of undercuts in the moulds.

Another inconvenience is that concerning the limited safety offered by the cap, because of the incautious opening which can be achieved in any case by children of a certain age.

In fact, although the opening requires the pressing down of the cap against the bottle and the rotation of the same at the same time, it is also true that such type of movement does not require any excessive ability.

The purpose of the present invention is that of overcoming the abovementioned inconveniences by creating a cap being equipped with a seal and suited to resist the incautious opening attempts made by children or by persons with limited intellectual capacity. Another purpose is that of obtaining a cap suited to be used on a bottle having a smooth neck, in order to do away with indented rings on the same, which complicate its manufacture because of the presence of undercuts in the moulds.

The above-mentioned purposes are reached by a cap consisting of three parts, i.e. by an inside element being screwed to the bottle, by an upper push-button provided with a cog-rim and by an outside element, such that the untightening of said cap can only occur by a pressing action against the bottle on the push-button and, at the same time, by rotation action of the outside element in the untightening direction, since the push-button functions as a transmission means of the rotation between the inside element and the element being screwed on the bottle.

According to the invention, the inside element is screwed to the bottle by means of a suitable thread being present on the inside wall; besides, said element presents one or two cogs on its outside cylindrical surface, which engage with another series of cogs being present on the facing surface of the more internal element, being coaxially connected with it. The cogs are positioned so that they only engage with each other when the cap is tightened, while they slide on each other when the outside cap is turned in the untightening direction of rotation.

The push-button is a connecting element which is interposed between the outside element and the inside one, and at first it is protected and covered by a tear-off seal, being a part of the outside element.

The push-button presents on its lateral surface a series of cogs which engage with the cogs belonging to the outside element, so that both the push-button and the outside element are forced to rotate together. The push-button presents on its lower surface a radial series of cogs, so that when it is pressed downward, its cogs engage with other cogs being present on the upper flat surface of the inside element. In this way, i.e. by keeping the push-button pressed downward and by rotating the outside cap in the untightening direction, the opening of the bottle is obtained.

BRIEF DESCRIPTION OF THE DRAWINGS

Other constructive and functional characteristics will be better understood from the description of a preferred form of execution of the invention, being given by way of example only, but which is not meant to limit its scope and which is illustrated in the enclosed figures of drawing, where.

DETAILED DESCRIPTION OF THE INVENTION

Figure 3:
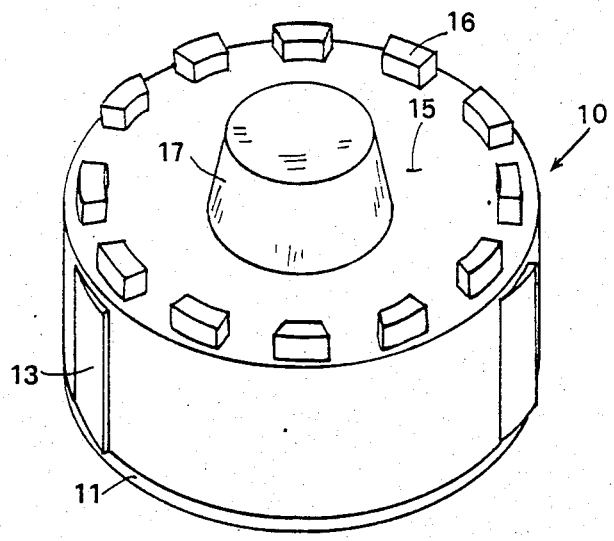
FIG. 3 is a perspective view of the inside element which is screwed on the bottle.
Figure 4:
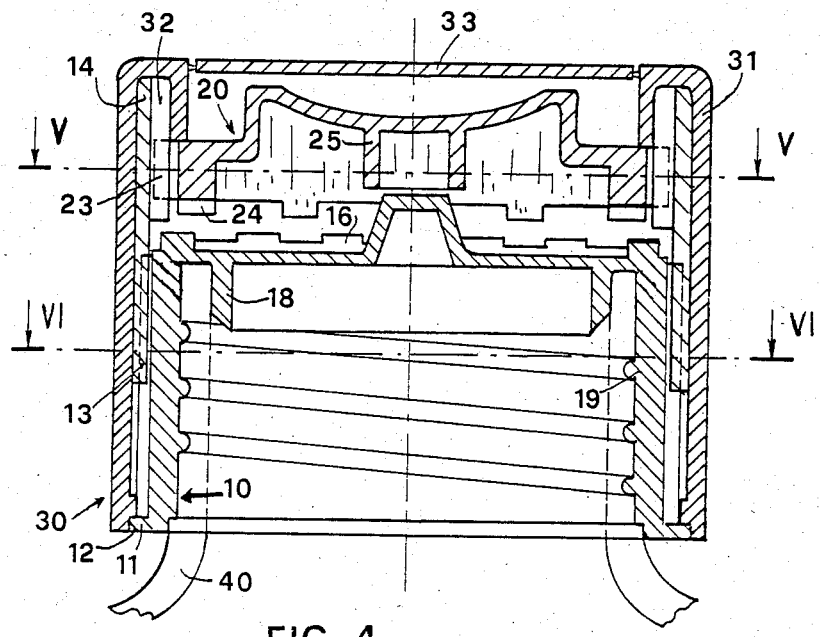
FIG. 4 is a cross-section of the cap tightened on a bottle.

With reference to the above-mentioned figures, in FIG. 3 and FIG. 4 the inside element of the cap is indicated with 10. It is provided with thread 19 which is screwed directly on the bottle neck 40; said inside element is made of plastic and it presents an almost cylindrical bottom part ending with a protruding circular edge 11 which engages with an equal seat 12 being present on the internal surface of outside element 30. Ring 11 has the task of keeping the outside element 30 centered on the inside element 10.

Figure 6:
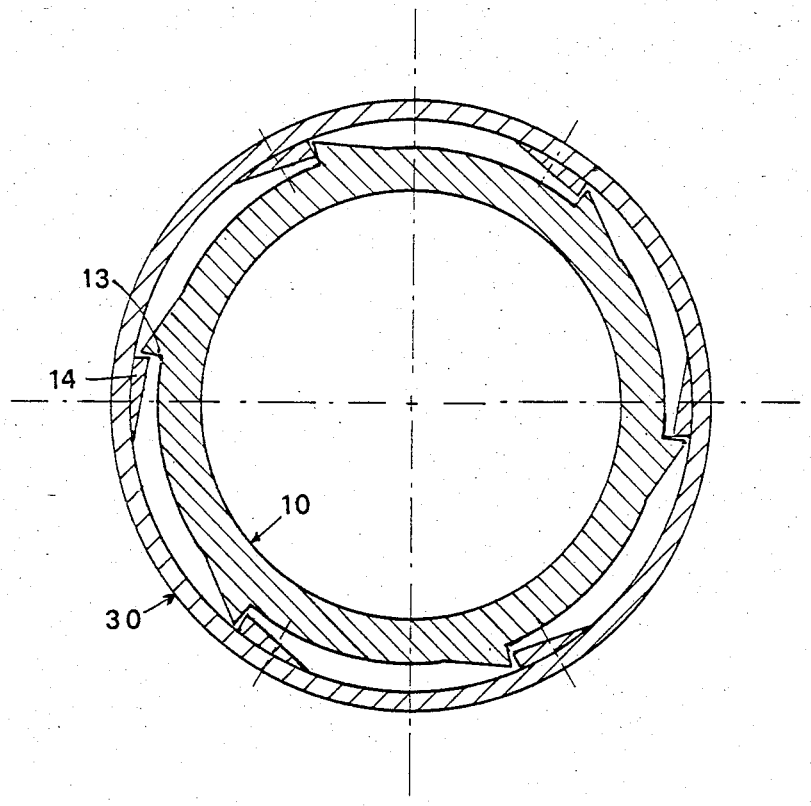
FIG. 6 is a cross-section of the cap of FIG. 4, following the line VI—VI.

The outside surface of the cylindrical part of the inside element 10 presents a cogged rim, the cogs 13 of which are clearly visible in FIG. 3 and in the cross-section of FIG. 6. These cogs have a nearly triangular shape and an inclination such that they can engage with the corresponding cogs 14 of another cogged rim being present on the internal cylindrical surface 31 of the outside element 30 only when the cap is made to rotate from left to right, that is to say in the usual tightening sense; when, on the other hand, the cap is made to rotate in the opposite direction, i.e. from right to left, the cogs 14, which also have a triangular shape, but a reverse profile, skip over the cogs 13 and the two cogged rims slide on each other. By observing FIG. 6 the above description becomes very clear. It can be observed that the sliding of the cogs is made easier by the elasticity of wall 31, obtained by using a particularly soft and flexible plastic material having the appropriate thickness.

Continuing to refer to the inside element 10 and also to FIG. 3, it can be observed that the upper part of said element has a flat circular surface 15, at the edge of which there is yet another series of cogs 16 and at the center of surface 15 there is a body having the shape of a truncated cone 17, which, as will be seen later on, is the element which pushes back push-button 20. Moreover, in the internal part of surface 15 there is a cylindrical body 18 which engages with the inside wall of the bottle edge 40, thereby preventing the liquid from flowing out of the bottle.

Figure 1:
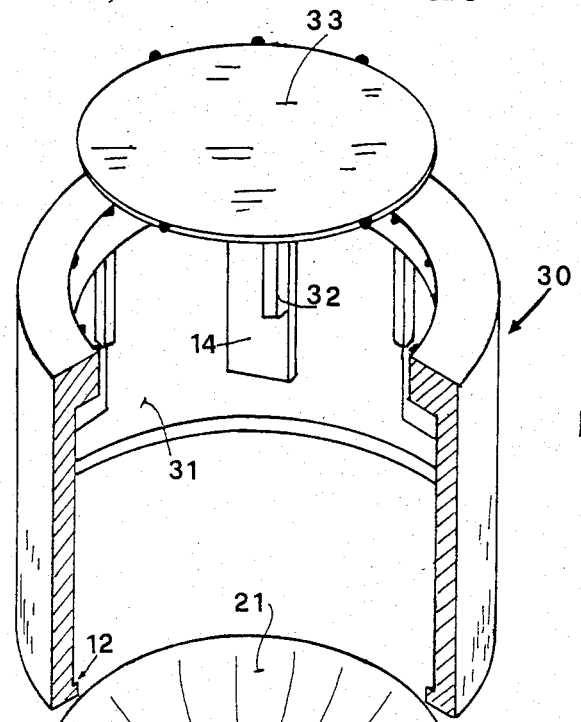
FIG. 1 is a perspective and partially cross-sectioned view of the outside element of the cap.
Figure 2:
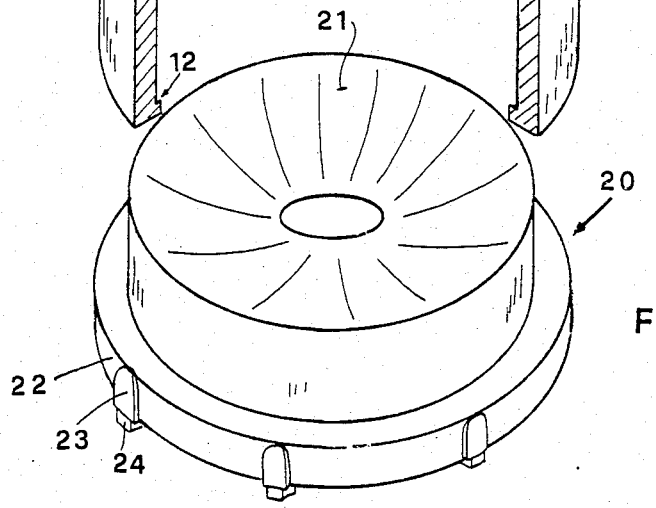
FIG. 2 is a perspective view of the push-button.
Figure 5:
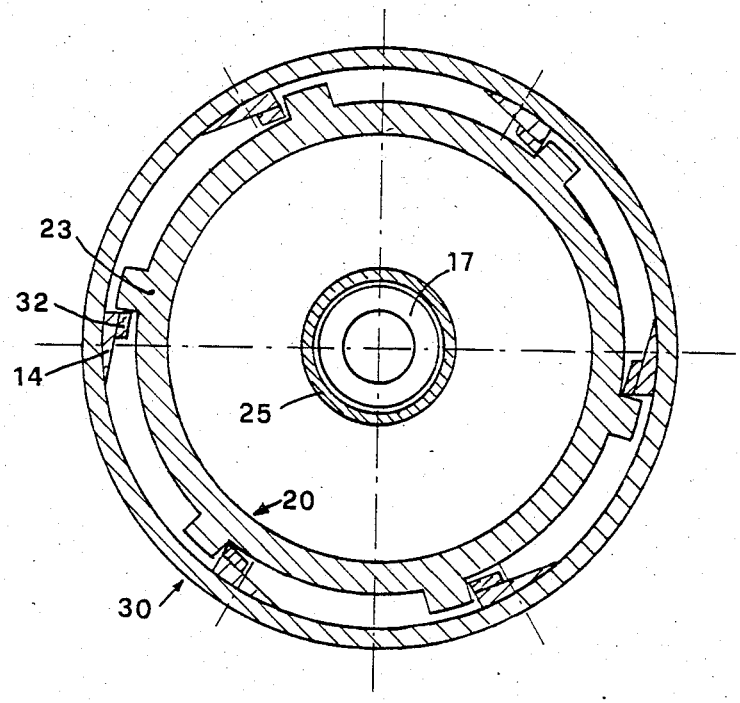
FIG. 5 is a cross-section of the cap of FIG. 4, following the line V—V.

Push-button 20 is virtually a cylindrical body having two diameters, in which the upper part presents a concave wall 21 having its concavity turned upwards and being such as to make the positioning of the finger of the hand easy during the cap opening operation. In its bottom part push-button 20 presents a cylindrical body 22 having a larger diameter than the upper body and presenting on its external cylindrical surface a cogged rim consisting of the flat cogs 23, which force push-button 20 and the outside element 30 of the cap to turn together in direction of rotation. In fact, as can be observed in FIG. 1 and in FIG. 5, each cog 14 belonging to the outside element 30 presents on its inclined surface another moulded cog 32 being shorter than cog 14. Therefore, the height of the whole cog, which is the sum of the thicknesses of cog 14 and cog 32 being present on the internal cylindrical wall of the outside element 30, prevents any skipping over of cog 23, no matter what the direction of rotation.

In its bottom part, in this case in correspondence with the cogs 23, push-button 20 presents a second cogged rim having straight cogs 24, which, when push-button 20 is pushed by the finger pressure against the inside element 10, engage with the cogs 16 of the inside element 10.

In fact, after the tear-off seal 33, which prevents the access to push-button 20, has been removed, if one exerts a certain pressure with a finger on push-button 20 in the direction of the axis of the bottle and against it, said push-button will lower itself for a certain distance, as far as this is permitted by the elastic deformation of the little cylinder 25 being present under push-button 20 and which engages with body 17 having the shape of a truncated cone of inside element 10. This lowering is sufficient to cause the cogs 24 of the push-button to engage with the cogs 16 of the inside element 10 which is screwed on the bottle neck 40. When the cogs 16 and the cogs 24 are engaged with each other, a rotation movement of the cap in the untightening direction insures the loosening of the whole cap, including the inside element 10. In fact, if the outside element 30 is made to rotate in the untightening direction, push-button 20 is also made to rotate, since its cogs 23 are always engaged with the cogs 14 and 32 of the outside element, and, at the same time, the rotation of push-button 20 is transmitted to the inside element 10 by means of the above-mentioned coupling between the cogs 24 and 16.

As can be seen, the untightening of the cap occurs independently of the working of the coupling between the cogs 13 and 14. When the pressing action exerted on push-button 20 stops, the push-button itself returns to its upward position because of the action of the elastic charge having accumulated on the central cylindrical part 25, which has been pressed on the truncated cone 17 belonging to element 10.

In actuality, in order to tighten the cap on the bottle it is suffcient to normally tighten the outside element 30, in order to obtain that the inside element 10 engages with the thread of the bottle, since the rotation of the outside element 30 is transmitted to the inside element 10 by the engagement between the cogs 13 and 14. On the other hand, in order to obtain the opening of the bottle, it is necessary, first to tear off the seal, in order to have access to the push-button 20 and, therefore, to be able to operate it, and after that, it is necessary to keep push-button 20 pressed downward and to rotate the outside element 30 at the same time. It is easy to understand that only the co-ordination of the two movements permits the opening of the bottle, which is practically impossible for children or for people who are unable perform co-ordinated movements.

It is also to be remarked that, given the particular position and construction of the tear-off seal 33, which is placed at the upper end of the outside element 30, it is not necessary to provide the bottle with an indented ring, in order to hold the seal, so that the manufacture of the bottle is simplified by adopting this cap.

According to a constructive variation of the just described cap, the rotation in any direction between the outside element 30 and the push-button 20 can be insured, not through the engagement between the cogs 32 of the outside element and the cogs 23 of the push-button, but through a special form, a polygonal one for instance, of the two surfaces facing each other. Thus the lateral surface 22 of the push-button can be polygonal and it can be brought in contct with an equally polygonal surface obtained in the internal wall 31 of the outside element 30 in its upper part in correspondence with the cogs 32, which in this case will not be present.

Obviously several variations can be performed on the just described cap during its manufacture, concerning for instance the shape and the number of cogs on the lateral surfaces of the inside element 10 or of the outside one 30, or the shape and the number of the cogs on the flat surfaces of the push-button and of the inside element, as well as any other functional element, which belong to the scope of the above-described invention, such as it is specified in the following claims.

I claim:

1. A safety opening cap, including an inside element (10) which is screwed on the neck (40) of a bottle, a virtually cylindrical outside element (30) being coaxial with the inside element and a push-button (20) being inserted through the top of the outside element (30), characterized by the fact that the untightening of said cap from the bottle only occurs by rotating the outside element (30) while pressing the push-button (20) at the same time in its axial direction, the transmission of the rotation of the outside element (30) to the inside element (10) being insured by means of pairs of cogged rims (32, 23; 24, 16) acting between the outside element (30) and the push-button (20) and between the push-button (20) and the inside element (10).

2. A cap according to claim 1, characterized by the fact that the outside element (30) and the push-button (20) always turn together, whatever the direction of rotation, the cogs (23) on the external cylindrical surface (22) of the push-button (20) being always engaged with the corresponding cogs (32) being present on the internal surface (31) of the outside element (30).

3. A cap according to claim 1, characterized by the fact that the lowering of the push-button (20) causes the cogs (24) being present on its lower edge to engage with the corresponding cogs (16) being present on the upper surface (15) of the inside element (10).

4. A cap according to claim 1, characterized by the fact that the outside element (30) and the push-button (20) always turn together, no matter what the direction of rotation, because of the interaction of two polygonal lateral surfaces, which replace the cogs (23) of the lateral external surface of the push-button (20) and the cogs (32) being present on the internal surface (31) of the inside element (10) respectively.

5. A cap according to claim 1, characterized by the fact that the tightening on the bottle occurs by rotating only the outside element (30) being provided with a seal, or without it, the rotation being transmitted from the outside element (30) to the inside element (10) by two cogged rims (13, 14) facing each other, being present on the cylindrical surfaces of said elements and facing each other.

6. A cap according to claim 1, characterized by the fact that, when the pressure action on the push-button (20) stops, said push-button will move upward disengaging itself from the cogs (16) of the inside element (10), said movement being caused by the elastic charge having accumulated on the central cylindrical part (25) of the push-button having been pressed against the protrusion (17) having the shape of a truncated cone, being present on the upper part of the inside element (10).

* * * * *